United States Patent [19]

Kuchenbecker

[11] 4,210,246

[45] Jul. 1, 1980

[54] RECLOSABLE HINGED BLISTER CARD PACKAGE

[75] Inventor: Morris W. Kuchenbecker, Neenah, Wis.

[73] Assignee: American Can Company, Greenwich, Conn.

[21] Appl. No.: 958,716

[22] Filed: Nov. 8, 1978

[51] Int. Cl.[2] ..... B65D 83/00; B65D 85/14

[52] U.S. Cl. ..... 206/461; 206/467; 206/470; 206/621; 206/626

[58] Field of Search ..... 206/470, 461, 484, 626, 206/621, 468, 469, 467; 229/2.5, 45, 48 T

[56] References Cited

U.S. PATENT DOCUMENTS

| | | | |
|---|---|---|---|
| 2,923,455 | 2/1960 | Tingley | 229/45 |
| 3,127,010 | 3/1964 | Capezzuto | 206/626 |
| 3,650,386 | 3/1972 | Tigner | 206/631 |
| 3,792,181 | 2/1974 | Mahaffy et al. | 206/631 |
| 3,910,410 | 10/1975 | Shaw | 229/48 T |
| 3,942,640 | 3/1976 | Hellstrom | 206/470 |
| 3,967,730 | 7/1976 | Driscoll et al. | 206/470 |

*Primary Examiner*—William T. Dixson, Jr.
*Attorney, Agent, or Firm*—Robert P. Auber; Ira S. Dorman; Harry C. Engstrom

[57] ABSTRACT

A reclosable hinged blister card package wherein peripheral flanges on the clear plastic blister are adhered to a paperboard card which in one embodiment is suitably cut-scored along the adhered areas to allow defined ply separation of the card for opening the blister. A hinge line is formed in the card above the bottom flange to allow hinged opening of the blister. An opening tab formed on the blister overlays an opening in the card. Locking ears on the opening tab are adapted to be pushed through the cut-out opening to lock the blister in reclosed position. Another version of the package provides reclosure and locking with pressure sensitive adhesive on the side peripheral flanges of the blister which adheres to adhesive on the underlying portions of the card.

12 Claims, 12 Drawing Figures

RECLOSABLE HINGED BLISTER CARD PACKAGE

BACKGROUND OF THE INVENTION

This invention relates to blister card packages and more particularly to such a package with a reclosable hinged plastic blister.

DESCRIPTION OF THE PRIOR ART

Blister card packages are commonly formed by adhering a rigid preformed plastic "blister" or product holding unit to an underlying card of paperboard with the product confined between them. The packages are typically opened by ripping the card from the plastic blister or otherwise destroying the card to get at the contents of the package.

For certain types of products being packaged, such as loose items or a plurality of items not all of which will be used at once, it is desirable to allow the user to securely reclose the package after initial opening. Various types of reclosable packages are known in the art. However, a typical problem encountered in reclosable packages has been the difficulty of securely sealing the periphery of the plastic blister to the underlying paperboard card, and yet allowing the package to be opened without ruining the integrity of the card and thereby making it unsuitable for further use.

SUMMARY OF THE INVENTION

The reclosable hinged blister card package of this invention has a clear plastic blister or product holding unit which includes a raised product holding portion and a peripheral attaching flange adhered to the front surface of a paperboard card. The side portions of the peripheral flange in one embodiment are adhered to the card between double cut-score lines or a single cut-score line and the edge of the card. The cut-score lines extend partially through the thickness of the card. The card has an internal edge defining an opening therein and the blister has an opening tab extending over a portion of the opening. The opening tab preferably has locking ears which extend outwardly beyond the edge of the opening and are adapted to be pushed through the opening when the blister is reclosed to overlay the back surface of the card to lock the package reclosed. A hinge line is formed in the card underlying and coincident with the bottom edge of the raised product holding portion of the blister.

In another embodiment, the side peripheral flanges may be adhered to the card with pressure-sensitive adhesive having less internal cohesion than adhesion to either the card or the blister flanges. In this embodiment, cut-score lines are not formed on the surface of the card, and reclosure of the card is accomplished by pressing the adhesive covered flanges into contact with the card.

The blister may be formed with the opening tab extending from the raised product holding portion and separated by cuts from the adjacent top flange portion. The plastic blister in this embodiment is especially adapted to be die cut from a larger blank with the opening tab of each blister dovetailing with a notch in the bottom flange of the plastic blister above it in the blank. Substantial savings in plastic material result from such a construction.

Further objects, features and advantages of the invention will be apparent from the following detailed description taken in conjunction with the accompanying drawings.

DESCRIPTION OF THE PREFERRED EMBODIMENTS

Figure 1:
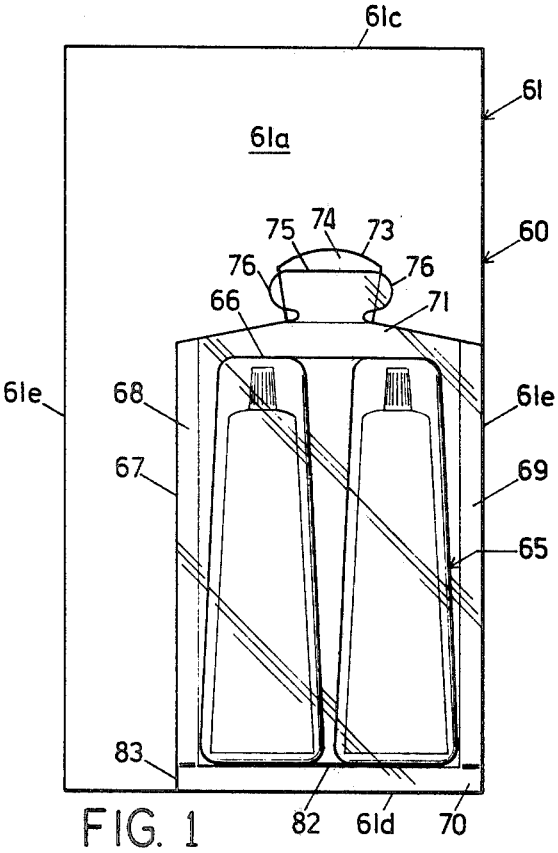
FIG. 1 is a plan view of a reclosable hinged blister card package embodying the principles of the invention.

With particular reference to the drawings, a blister card package in accordance with this invention is shown generally at 60 in FIG. 1. The package 60 has a paperboard card 61 having a front surface **61*a*, a back surface 61*b*, a top edge 61*c*, bottom edge 61*d* and side edges 61*e*. A clear plastic product holding unit or blister 65, comprised of a raised product holding portion 66 and a peripheral flange 67, is attached to the front surface 61*a* of the paperboard card. The flange 67 has side flanges 68 and 69 and a bottom flange 70 extending respectively from the left side edge, right side edge and bottom edge of the raised product holding portion 66. The side flanges 68 and 69 and the bottom flange 70 are adhered with a strong adhesive to the front surface of the card. The top flange 71**, which extends from the top edge of the raised holding portion, is not adhered to the top surface of the card in this particular embodiment.

The card 61 has an internal edge 73 defining an opening 74 in the card, which may be cut out of the card as shown or which may simply be a slash through the card. A flexible opening tab 75 extends from the top flange 71 part way over the opening 74. The tab 75 may be pushed through the opening to engage the back surface of the card with its extending locking ears 76 to allow locking reclosure of the package.

Cut score lines 77, 78, 79, 80 and 81 are formed in the front surface of the card and extend partially through the thickness of the card at positions along the inner and outer edges of the side flanges 68 and 69. The outer edge of the right side peripheral flange 69 is coincident with the right side cut edge **61*e* of the paperboard card 61. Therefore, upon opening of the blister card package, the paperboard will split between the cut score lines 77 and 78 on the left hand side and between the cut score line 80 and the cut edge 61***e* of the card on the right side of the package, with part of the paperboard adhering to the flangers and a part of the paperboard remaining integral with the paperboard card 61.

Figure 3:
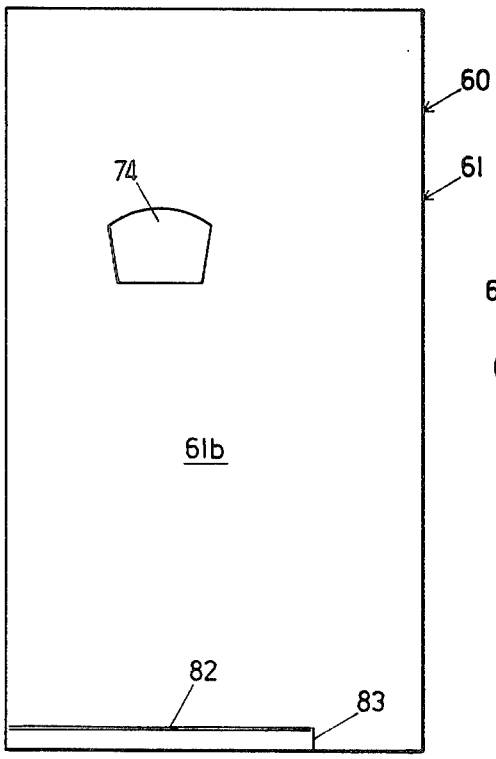
FIG. 3 is a plan view of the back side of the package of FIG. 1.
Figure 4:
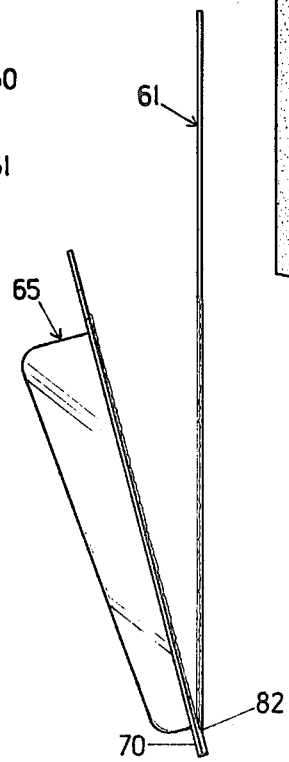
FIG. 4 is a right side view of the package of FIG. 1 in partially opened position.

The hinged opening of the card is provided about a hinge line 82 formed in the card 61 at a position along and coincident with the bottom edge of the raised product holding portion and extending between the outside edges of the side peripheral flanges. A cut line 83 is formed in the card extending from the bottom edge 61*d* of the card up to the hinge line 82 along the outside edge of the side peripheral flange 68. The hinge line 82 can be formed as a line of alternating perforations, a cut score line, a line of bending weakness or fold line, or preferably a crease line as shown in the back side view of FIG. 3. As shown in FIG. 4, the plastic blister 65 rotates about the hinge line 82 with the bottom flange 70 and the portion of the card underlying it bending backwards. The cut line 83 allows the bending about the hinge line 82 to take place freely.

Figure 2:
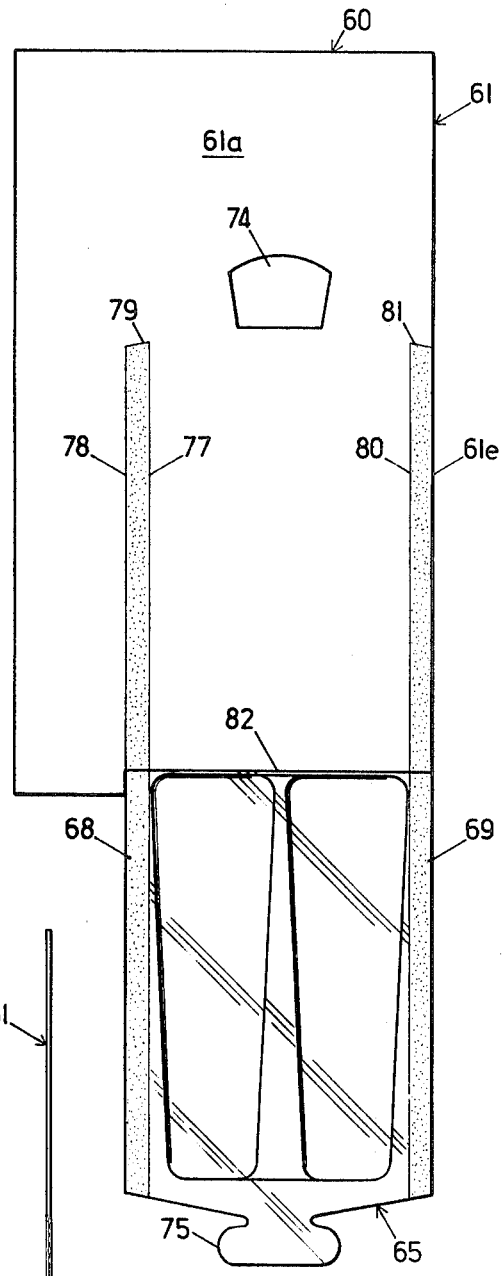
FIG. 2 is a plan view of the package of FIG. 1 in opened position.

The plastic holding unit is shown in its fully open position in FIG. 2 in which the surface of the flanges 68 and 69 are essentially parallel with the flat face of the card 61 and the bottom flange 70 is bent over to the back surface 61*b* of the card.

Figure 5:
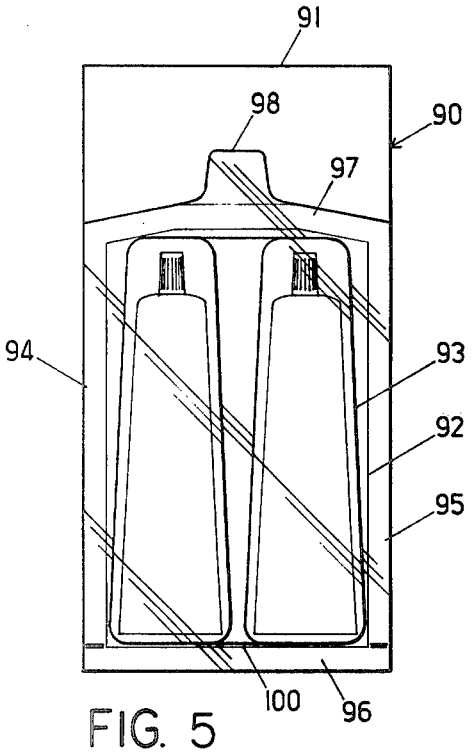
FIG. 5 is a plan view of another embodiment of a package embodying the principles of the invention.
Figure 6:
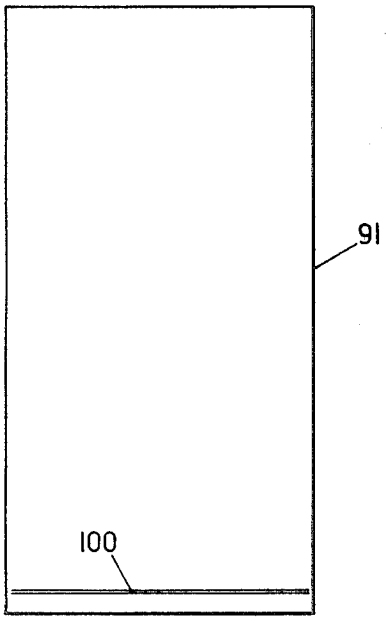
FIG. 6 is a plan view of the back side of the package of FIG. 5.
Figure 7:
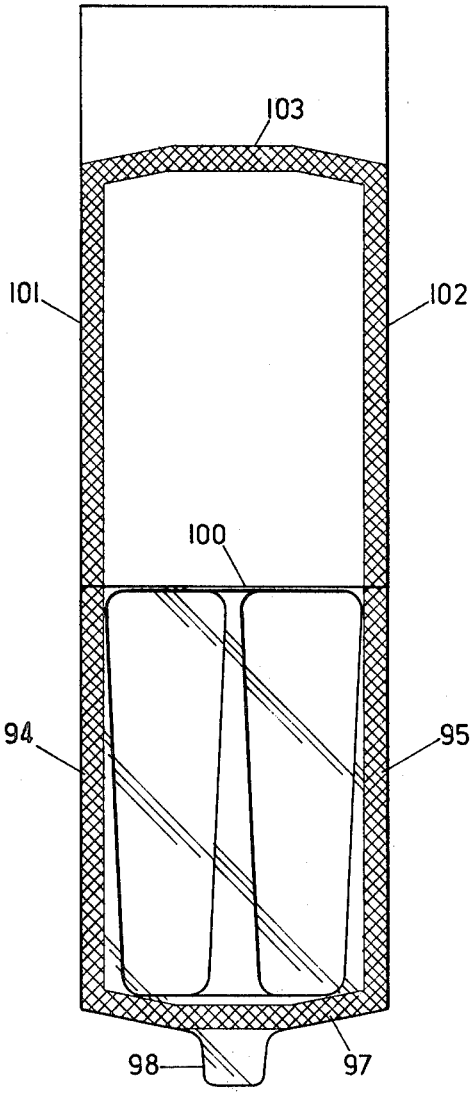
FIG. 7 is a plan view of the package of FIG. 5 in opened position.

Another embodiment of the package is shown generally at 90 in FIG. 5. The package 90 consists of a paperboard card 91 and a plastic blister 92 adhered thereto. The blister 92 has a raised product holding portion 93 formed substantially as described above with outwardly extending left-hand side flange 94, right-hand side flange 95, bottom flange 96 and a top flange 97. An opening tab 98 extends from the top flange 97 to allow grasping by a finger of the user to open the package. The outside edges of the side flanges 94 and 95 are coincident with the cut side edges of the card 91, and the bottom edge of the bottom flange 96 is coincident with the bottom edge of the card. It is apparent that if the edges of the peripheral flange were not coincident with the edges of the card, hinged opening could be obtained by running the hinge line across the width of the card beyond the edges of the flange. Alternatively, cuts in the card, such as described above, could be utilized to allow free hinged opening of the blister.

A hinge line 100 is formed in the card 91 along the bottom edge of the raised holding portion 93 extending from the outside edge of the left side flange 94 to the outside edge of the right side flange 95. The hinge may be formed in the same manner as described above for the hinge line 82.

Contact pressure adhesive adheres side portions 101 and 102 of the card respectively to the left side flange 94 and the right side flange 95. The top flange 97 may also be adhered by contact pressure adhesive to the underlying portion 103 of the card. The adhesive that is utilized may be of any well known contact pressure type which has greater adhesion to the surface to which it is applied then its own internal cohesion. The plastic blister may thus be opened by a user by pulling on the tab 98 and breaking the bond between the side and top flanges of the blister and the underlying card, with the contact pressure adhesive allowing the card to be securely stuck back together.

The bottom flange 96 is adhered to the surface of the card underlying it with a securely holding adhesive which will not allow the flange to be separated from the card when the package is opened up.

It is noted that in this embodiment, the closed card provides a complete seal around the entire product containment area within the raised product holding portion of the package.

Figure 8:
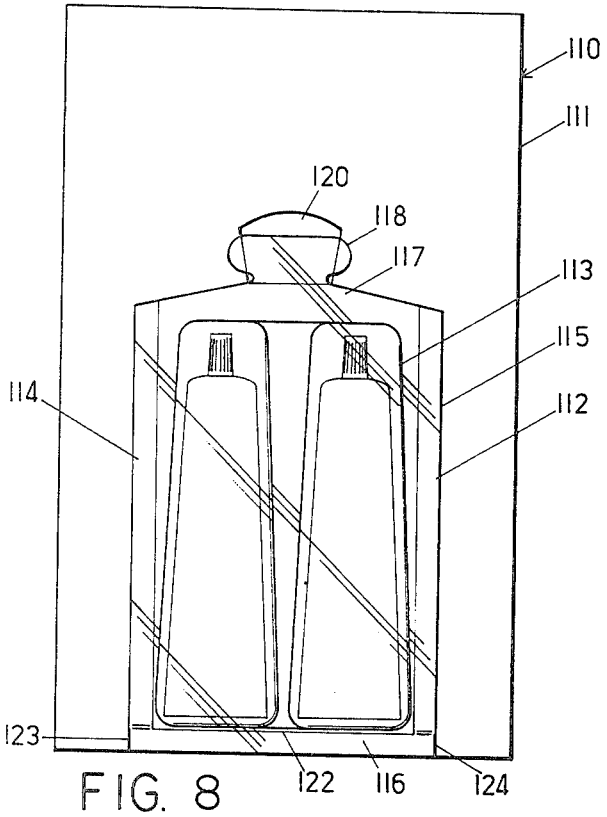
FIG. 8 is a plan view of yet another embodiment of a package embodying the principles of the invention.
Figure 9:
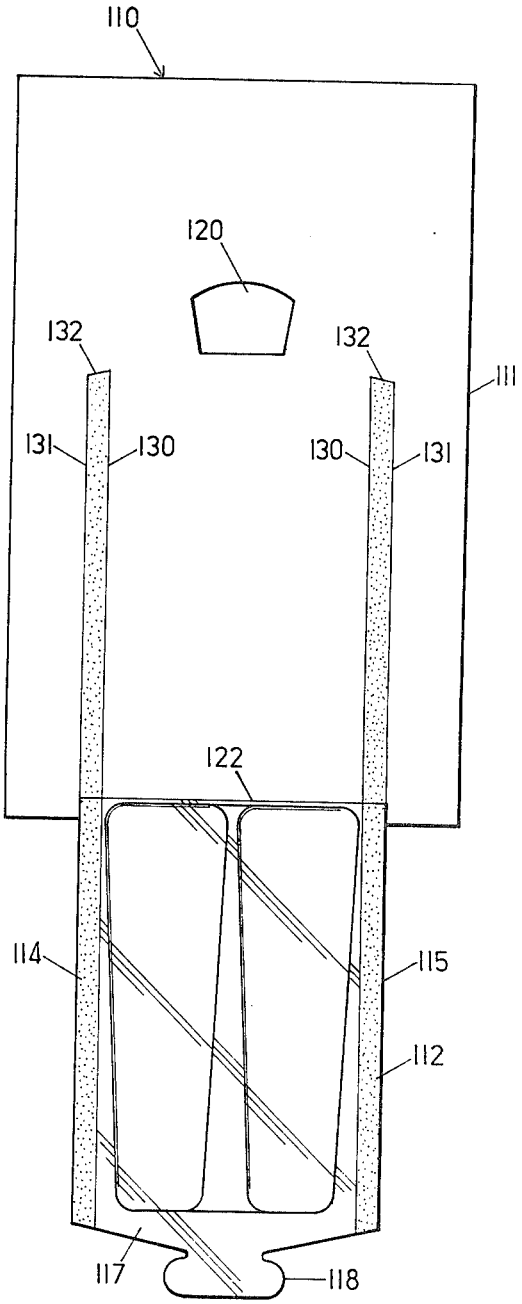
FIG. 9 is a plan view of the package of FIG. 8 in opened position.

Yet another embodiment of the package is shown in FIG. 8 at 110. The package 110 comprises a paperboard card 111 and a clear formed plastic blister 112. The blister package 110 is similar to the package 60 shown in FIG. 9, and has a raised product holding portion 113 and side flanges 114 and 115, bottom flange 116 and a top flange 117. A locking tab 118 extends from the top of the top flange 117 and partially overlays an opening 120 in the card for reclosure purposes as described above.

A hinge line 122 is formed along the bottom edge of the raised product holding portion and extends from the outer edge of the side flange 114 to the outer edge of the side flange 115. The hinge line 122 is formed as described above, preferably as a crease line impressed in the card. As shown in FIG. 8, the outside edges of the side flanges 114 and 115 are positioned inwardly of the outside edges of the card 111. Cut lines 123 and 124 extend from the bottom edge of the card 111 along the outside edges of the side flanges 114 and 115 up to the hinge line 122 to allow the blister to open about the hinge line without interference from the card.

The side flanges 114 and 115 and the bottom flange 116 are securely sealed with a strong adhesive to the front surface of the underlying card 111. To allow opening and splitting of the paperboard of the card, cut score lines 130 are formed along the inner edges of the side flanges, and cut score lines 131 and 132 are formed along the outer edges of the side flanges. Upon opening of the card, splitting of the paperboard card takes place between these cut score lines, leaving a portion of the paperboard adhered to the flanges 114 and 115 and a portion remaining integral with the remainder of the card 111.

Figure 10:
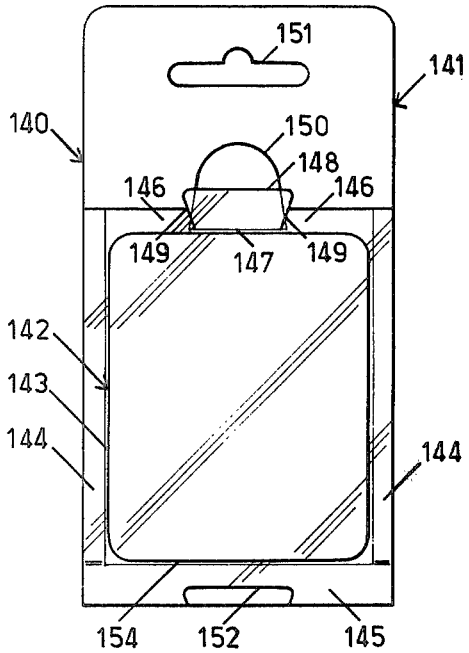
FIG. 10 is a plan view of a package embodying the principles of the invention having an alternative blister configuration.

An alternative embodiment of a reclosable blister card package is shown generally at 140 in FIG. 10. The package 140 consists of a flat paperboard card 141 and a clear formed plastic blister 142. The blister 142 has a raised product holding portion 143, side peripheral flanges 144, a bottom flange 145, and a split top flange 146 extending from the top edge 147 of the product holding portion. The two portions of the top flange 146 extend on either side of a flat tab 148 which extends directly outward from the top edge 147 of the holding portion 143, and which is physically separated from the top flange portions 146 by cut lines 149. The locking tab 148 overlays and is adapted to be pushed through an opening 150 in the paperboard card for reclosure. The card 141 also includes an optional product hanger opening 151 which allows the card to be hung on a rack for product display purposes. The bottom flange 145 has a notch 152 formed therein which has the same shape as the portion of the opening tab 148 which extends outwardly of the top flange 46 for the reasons described below.

Figure 11:
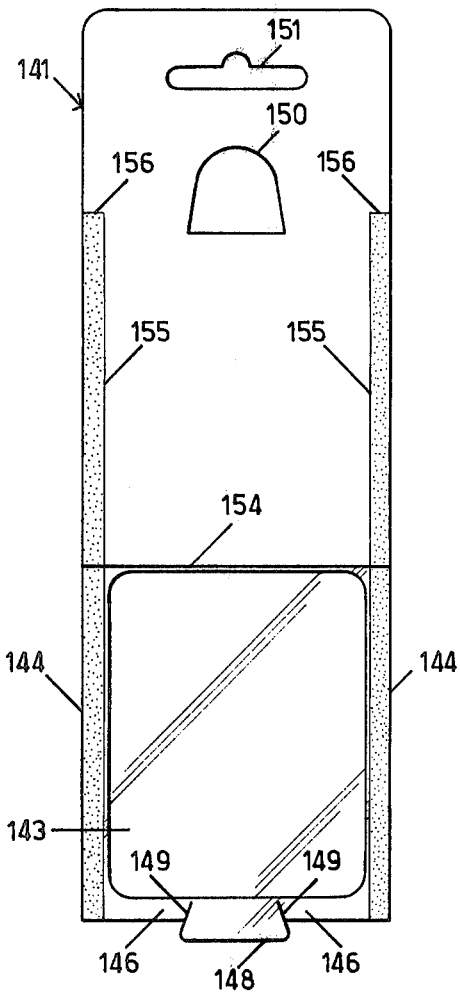
FIG. 11 is a plan view of the package of FIG. 10 in opened position.

A hinge line 154 is formed along the bottom edge of the blister and extends between the outer edges of the card. The hinge line 154 is again preferably formed as a crease line impressed in the card, although it may be formed in any manner as described above. As best shown in FIG. 11, cut lines 155 cut partially through the card extend from the hinge line along the inside edge of the side flanges 143 to the top flange of the card. Similar cut lines 156 extend from the inner cut score lines 155 to the outside edges of the card.

The side flanges 144 and bottom flange 145 are securely sealed with a strong adhesive to the front surface of the underlying card. Upon opening of the card, the paperboard card will split under the side flanges 144 between the cut score lines and the edges of the card, leaving a portion of the paperboard adhered to the side flanges and a portion remaining integral with the card. The package may be reclosed by pushing the opening tab 148 through the opening 150 until the flared extending top edges of the tab 148 are pushed through the opening to make contact with the back surface of the card and lock the card in a reclosed position. It is apparent that the tab 148 can move freely about its attachment to the blister since the cut lines 149 allow the tab to move independently of the top flange portions 146.

Figure 12:
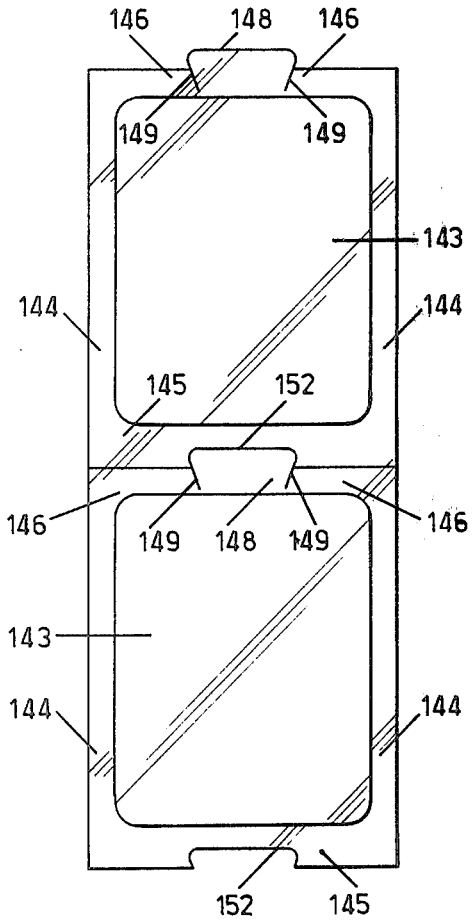
FIG. 12 is a plan view of the plastic blister portion of the package of FIG. 10 shown in engagement with another plastic blister after die cutting of the plastic blank.

The plastic blister 142 is especially adapted to be die cut from a larger plastic blank with minimum waste of the plastic blank material. This advantage is best shown with reference to the view of FIG. 12, which shows two plastic product holding units in mated engagement as they would appear after die cutting from a larger plastic blank. The top flange 146 of the lower unit is in abutting engagement with the bottom peripheral flange 145 of the upper unit, and the opening tab 148 of the lower blister extends into the notch 152 cut in the bottom flange of the upper blister. Because of this dovetailing of the opening tab into the notch in the bottom flange, no scrap plastic need be cut from the blank in order to form the opening tab except at the very top edge of the blank. It is also noted, particularly from an examination of FIG. 10, that the overall length of the underlying paperboard card can be made shorter, if desired, since the distance that the opening tab 148 extends from the product holding portion 143 is minimized by this design. For example, the paperboard card 141 shown in FIG. 10 could be cut off just above the opening 150 without affecting the function of the blister package.

It is understood that the invention is not confined to the particular construction and arrangement of parts herein illustrated and described, but embraces all such modified forms thereof as come within the scope of the following claims.

I claim:

1. A reclosable hinged blister card package, comprising:

(a) a paperboard card having a front surface and a back surface, bottom, top and side edges, and an internal edge defining an opening in said card;

(b) a plastic blister having a raised product holding portion having bottom and side edges, and a peripheral flange at the sides and bottom of said product holding portion, said peripheral flange being adhered to the front surface of said card;

(c) opening tab means on said plastic blister and extending over at least a portion of said opening in said card and adapted to be pushed through said opening when said blister is reclosed for locking said blister in its reclosed position;

(d) cut score lines in the front surface of said card and extending partially through the thickness of said card along the inner and outer edges of the portions of said peripheral flange at the sides of said product holding portion, whereby said blister may be lifted by said opening tab means with confined ply separation of the paperboard card at the portions thereof which are adhered to the side portions of said peripheral flange without breaking the bond between said flange and the front surface of said paperboard card; and (e) a hinge line in said card formed along the bottom edge of said product holding portion and extending to the outside edges of said peripheral flange, and cuts formed in said card extending along the outside edges of said side peripheral flange portions from the bottom edge of said card to the ends of said hinge line, whereby said plastic blister can be swung open about said hinge line.

2. A reclosable hinged blister card package, comprising:

(a) a paperboard card having a front surface and a back surface, bottom, top and side edges, and an internal edge defining an opening in said card;

(b) a plastic blister having a raised product holding portion having bottom and side edges, and a peripheral flange at the sides and bottom of said product holding portion, said peripheral flange being adhered to the front surface of said card with one side edge of said flange at one of the side edges of said card;

(c) opening tab means on said plastic blister and extending over at least a portion of said opening in said card and adapted to be pushed through said opening when said blister is reclosed for locking said blister in its reclosed position;

(d) cut score lines in the front surface of said card and extending partially through the thickness of said card along the inner and outer edges of the portions of said peripheral flange at the sides of said product holding portion except along the one side edge of said flange which is at one of the side edges of said card, whereby said blister may be lifted by said opening tab means with confined ply separation of said paperboard card at the portions thereof which are adhered to said peripheral flange without breaking the bond between said flange and the front surface of said paperboard card; and (e) a hinge line in said card formed along the bottom edge of said product holding portion and extending to the outside edges of said peripheral flange, and a cut formed in said card along the outside edge of said side peripheral flange portion not at the edge of said card, said cut extending from the bottom edge of said card to the end of said hinge line, whereby said plastic blister can be swung open about said hinge line.

3. A reclosable hinged blister card package, comprising:

(a) a paperboard card having a front surface and a back surface, bottom, top and side edges, and an internal edge defining an opening in said card; P1

(b) a plastic blister having a raised product holding portion having bottom and side edges, and a peripheral flange at the sides and bottom of said product holding portion, said peripheral flange being adhered to the front surface of said card with the outer side edges of said flange at the side edges of said card;

(c) opening tab means on said plastic blister and extending over at least a portion of said opening in said card and adapted to be pushed through said opening when said blister is reclosed for locking said blister in its reclosed position;

(d) cut score lines in the front surface of said card and extending partially through the thickness of said card along the inner and outer edges of the portions of said peripheral flange at the sides of said product holding portion except along the outer side edges of the said flange, whereby said blister may be lifted by said opening tab means with confined ply separation of said paperboard card at the portions thereof which are adhered to the side portions of said peripheral flange without breaking the bond between said flange and the front surface of said paperboard card; and (e) a hinge line in said card formed along the bottom edge of said product holding portion and extending to the outside edges of said card, whereby said plastic blister can be swung open about said hinge line.

4. The reclosable hinged blister card package of claim 1, 2 or 3 wherein said opening tab means includes locking ears extending outwardly beyond the edge of said opening in said card, said ears being adapted to be pushed through said opening when said blister is reclosed to overlay the back surface of said card to lock said blister in a reclosed position.

5. The reclosable hinged blister card package of claim 1, 2 or 3 wherein said hinge line is formed as a crease line impressed in said card.

6. A reclosable hinged blister card package, comprising:

(a) a paperboard card having a front surface and a back surface, and bottom, top and side edges;

(b) a plastic blister having a raised product holding portion having bottom and side edges, and a peripheral flange at the sides and bottom of said product holding portion, the bottom portion of said peripheral flange being securely adhered to the front surface of said card and the side portions of said peripheral flange being adhered to the front surface of said card with a pressure-sensitive adhesive having greater adhesion to both the card and the peripheral flange than internal cohesion;

(c) opening tab means on said plastic blister for grasping by a user to pull said blister from said underlying card; and (d) a hinge line in said card formed along the bottom edge of said product holding portion and extending to the outside edges of said card, whereby said plastic blister can be swung open about said hinge line and can be reclosed by readhering the pressure-sensitive adhesive on the side flanges to the underlying card.

7. A reclosable hinged blister card package, comprising:

(a) a paperboard card having a front surface and a back surface, and bottom, top and side edges;

(b) a plastic blister having a raised product holding portion having bottom and side edges, and a peripheral flange at the sides and bottom of said product holding portion, the bottom portion of said peripheral flange being securely adhered to the front surface of said card and the side portions of said peripheral flange being adhered to the front surface of said card with one side edge of said flange at one of the side edges of said card, said side flange portions being adhered to said card with a pressure-sensitive adhesive having greater adhesion to both the card and the peripheral flange than internal cohesion;

(c) opening tab means on said plastic blister for grasping by a user to pull said blister from said underlying card;

(d) a hinge line in said card formed along the bottom edge of said product holding portion and extending to the outer side edges of said peripheral flange, and a cut formed in said card along the outside edge of said side peripheral flange portion not at the edge of said card, said cut extending from the bottom edge of said card to the end of said hinge line, whereby said plastic blister can be swung open about said hinge line and can be reclosed by readhering the pressure-sensitive adhesive on the side flanges to the underlying card.

8. A reclosable hinged blister card package, comprising:

(a) a paperboard card having a front surface and a back surface, and bottom, top and side edges;

(b) a plastic blister having a raised product holding portion having bottom and side edges, and a peripheral flange at the sides and bottom of said product holding portion, the bottom portion of said peripheral flange being securely adhered to the front surface of said card and the side portions of said peripheral flange being adhered to the front surface of said card with a pressure-sensitive adhesive having greater adhesion to both the card and the peripheral flange than internal cohesion;

(c) opening tab means on said plastic blister for grasping by a user to pull said blister from said underlying card;

(d) a hinge line in said card formed along the bottom edge of said product holding portion and extending to the outside edges of said peripheral flange, and cuts formed in said card extending along the outside edges of said side peripheral flange portions from the bottom edge of said card to the ends of said hinge line, whereby said plastic blister can be swung open about said hinge line and can be reclosed by readhering the pressure-sensitive adhesive on the side flanges to the underlying card.

9. The reclosable hinged blister card package of claim 6, 7 or 8 including a top peripheral flange portion extending from the top of said product holding portion and formed continuously with the side portions of said flange and including pressure-sensitive adhesive adhering said top flange portion to the underlying card which has greater adhesion to said flange and said card then its internal cohesion.

10. The reclosable hinged blister card package of claim 6, 7 or 8 wherein said hinge line is formed as a crease line impressed in said card.

11. The reclosable hinged blister card package of claim 1, 2, 3, 6, 7 or 8 wherein said product holding portion has a top edge and wherein said opening tab means comprises a flat tab extending from the top edge of said product holding portion, said peripheral flange at the bottom of said product holding portion having a notch formed therein having the shape of said extending tab, whereby said product holding portion, opening tab, and peripheral flange portions are adapted to be cut from a plastic blank with said opening tabs dovetailing with said notches formed in said bottom peripheral flanges.

12. The reclosable hinged blister card package of claim 11 including two top peripheral flange portions extending from the top edge of said product holding portion on either side of said tab and separated therefrom by cut lines, said notch in said bottom peripheral flange having the shape of the portion of said tab which extends beyond said top flange portions, whereby said product holding portion, opening tab, and peripheral flange portions are adapted to be cut from a plastic blank with the extending portion of said opening tabs dovetailing with said notches formed in said bottom peripheral flanges.

* * * * *